US009799193B2

(12) United States Patent
King, Jr. et al.

(10) Patent No.: US 9,799,193 B2
(45) Date of Patent: Oct. 24, 2017

(54) SHOCK DETECTOR SYSTEMS

(71) Applicants: L. Herbert King, Jr., Chesterfield, MO (US); James Keeven, O'Fallon, MO (US); Frank Vlasaty, St. Louis, MO (US); Andrew Hill, St. Peters, MO (US)

(72) Inventors: L. Herbert King, Jr., Chesterfield, MO (US); James Keeven, O'Fallon, MO (US); Frank Vlasaty, St. Louis, MO (US); Andrew Hill, St. Peters, MO (US)

(73) Assignee: BIRCH TREE LLC, O'Fallon, MO (US)

( * ) Notice: Subject to any disclaimer, the term of this patent is extended or adjusted under 35 U.S.C. 154(b) by 0 days.

(21) Appl. No.: 15/330,129

(22) Filed: Aug. 11, 2016

(65) Prior Publication Data

US 2017/0109994 A1 Apr. 20, 2017

Related U.S. Application Data

(63) Continuation-in-part of application No. 14/999,165, filed on Apr. 5, 2016, which is a continuation-in-part of application No. 14/998,497, filed on Jan. 12, 2016, now Pat. No. 9,678,119, which is a continuation of application No. 13/987,731, filed on Aug. 26, 2013,
(Continued)

(51) Int. Cl.
*G08B 21/00* (2006.01)
*G08B 21/08* (2006.01)

(52) U.S. Cl.
CPC ..... *G08B 21/082* (2013.01)

(58) Field of Classification Search
None
See application file for complete search history.

(56) References Cited

U.S. PATENT DOCUMENTS 3,510,766 A 5/1970 Russel
3,662,260 A 5/1972 Thomas
(Continued)

FOREIGN PATENT DOCUMENTS

AU WO 2010078617 A1 * 7/2010 ..... G08B 21/082
CN 2125857 U 12/1992
(Continued)

OTHER PUBLICATIONS http://www.kmbc.com/news/Inventor-s-device-warns-of-lake-electricity-risk/15598478.
(Continued)

*Primary Examiner* — Adolf Dsouza
(74) *Attorney, Agent, or Firm* — Jacobson & Johnson LLC

(57) ABSTRACT

A shock detector system for determining the existence of a harmful electrical condition in a body of water proximate a first shock detector or a second shock detector with the first shock detector providing a danger signal if the harmful electrical condition proximate the first shock detector could injure or kill a person coming into contact with the body of water proximate the first shock detector and the second shock detector providing a caution signal if there is no harmful electrical condition detected by the second shock detector even though there is a harmful electrical condition proximate the first shock detector.

20 Claims, 8 Drawing Sheets

Related U.S. Application Data now Pat. No. 9,285,396, application No. 15/330,129, which is a continuation-in-part of application No. 15/165,371, filed on May 26, 2016, which is a continuation of application No. 13/987,731, filed on Aug. 26, 2013, now Pat. No. 9,285,396.

(60) Provisional application No. 61/743,184, filed on Aug. 28, 2012.

(56) References Cited

U.S. PATENT DOCUMENTS

| | | | |
|---|---|---|---|
| 3,784,903 | A | 1/1974 | Thomas |
| 3,869,668 | A | 3/1975 | Thompson |
| 4,270,307 | A | 6/1981 | Arigaya |
| 4,864,282 | A | 9/1989 | Toeg |
| 5,005,007 | A | 4/1991 | Weng |
| 5,146,208 | A | 9/1992 | Parra |
| 5,202,638 | A | 4/1993 | Kolz |
| 5,402,298 | A | 3/1995 | Gershen |
| 8,686,713 | B2 | 4/2014 | Cargill, III |
| 2004/0080320 | A1 | 4/2004 | Golub |
| 2005/0218902 | A1 | 10/2005 | Restaino et al. |
| 2008/0174441 | A1 | 7/2008 | Durand |
| 2011/0277488 | A1 | 11/2011 | Peretz |
| 2014/0062512 | A1 | 3/2014 | King, Jr. et al. |
| 2014/0062708 | A1 | 3/2014 | Cargill, III |

FOREIGN PATENT DOCUMENTS

| | | | |
|---|---|---|---|
| EP | 2189797 | A2 | 11/2008 |
| JP | H08201146 | A | 8/1996 |
| JP | H11241919 | A | 9/1999 |
| WO | WO 2010/078617 | | 7/2010 |
| WO | WO 2010/078617 | A1 | 7/2010 |

OTHER PUBLICATIONS http://www.komu.com/news/man-invents-dock-shock-alert-system-/#.UDQB7qEOxQE.facebook.

https://www.facebook.com/Dock-Shock-Alert-474581832560744/?hcref=PAGES TIMELINE.

U.S. Department of Agriculture. Effects of Electrical Voltage/Current on Farm Animals: How to Detect and Remedy Problems. Beltsville, MD: U.S. Department of Commerce, 1991.

Johnson, Donald. "The Case of Stray Voltage in a Lake." Electrical Construction and Maintenance (2009): pp. 1-5. Website.

http://www.docklifeguard.com.

https://www.facebook.com/474581832560744/videos/3810773824197/?comment id=10206443732628449&commenttracking=%7B%22tn%22%3A%22%7D.

www.midwestboatparty.com/forum/archive/index.php/t-32733.html.

www.youtube.com/watch?v=sDgRMAw2iBE.

http://www.kmbc.com/image/view/-/15599516/medRes/2/-/maxh/350/maxw/620/-/vnwhpm/-/Inventor-hopes-Dock-Shock-Alert-saves-lives.jpg.

https://youtu.be/shkhmZTTKdY.

https://www.facebook.com/Talkscheap?fref=ts.

https://www.facebook.com/Dock-Shock-Alert-474581832560744/.

* cited by examiner

SHOCK DETECTOR SYSTEMS

CROSS REFERENCE TO RELATED APPLICATIONS

This application is a continuation in part of application Ser. No. 14/999,165 filed Apr. 5, 2016 titled Shock Detector (pending), which is a continuation in part of application Ser. No. 14/998,497 filed Jan. 12, 2016 (pending), which is a continuation of application Ser. No. 13/987,731 filed Aug. 26, 2013 (now U.S. Pat. No. 9,285,396), which claim priority to provisional application Ser. No. 61/743,184 filed Aug. 28, 2012; this application is also a continuation in part of application Ser. No. 15/165,371 filed May 26, 2016 (pending), which is a continuation of application Ser. No. 13/987,731 filed Aug. 26, 2013 (now U.S. Pat. No. 9,285, 396).

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the problems that occur with an electrical fault in a body of water is that the current leakage into the body of water from the electrical fault can injure or kill a person through electrocution, which is often referred to as electric shock drowning. This invention relates generally to shock detectors and, more specifically, to shock detectors that can be used to prevent electric shock drowning by detecting the presence of an electric field and alerting a person that the body of water comprises a hazard to a swimmer or a person coming into contact with the body of water. Typically, the current leakage occurs from a faulty electrical connection on a boat or dock although other sources may create a hazardous water condition.

It is known that if a swimmer encounters a body of water with an electric field the swimmer can be electrocuted with a voltage gradient of as little as two volts per foot. The mere presence of the swimmer in the electric field causes the current flowing in the water to take a path of least electrical resistance through the swimmers body since the wet skin on a swimmer's body has a lower electrical resistance than the water surrounding the swimmer. If the voltage gradient is sufficiently high the current flowing through the swimmer's body can electrocute the swimmer. In still other cases a person may be electrocuted if he or she comes into incidental contact with a body of water, which has leakage from an electrical source.

In addition to the existence of a harmful voltage gradient in a body of water there is a need to safely locate the source of the harmful voltage gradient as well as to ensure those proximate the body of water that the water does or does not contain a hazardous electrical field.

Another problem with harmful electrical conditions in a body of water, such as harmful voltage or harmful current conditions that may injure or kill a person, is that the harmful electrical conditions may be localized in the body of water so that one portion of the body of water contains a harmful electrical condition while another portion of the same body of water does not contain the harmful electrical condition.

That is, the harmful electrical condition is dependent on various conditions including any underwater structures. Consequently, the existence and the shape of field of the harmful electrical condition proximate a shock detector may be beyond the visual alarm range or the audible alarm range of the shock detector. Thus, one may find that in one location in the body of water a shock detector indicates the presence of a harmful electrical condition and in another location in the same body of water a further shock detector, which may be out of sight of the first shock detector, does not indicate a harmful electrical condition. As a result one may not be alerted to a nearby presence of the harmful electrical condition until one is within the field of the harmful electrical condition.

SUMMARY OF THE INVENTION

A shock detector system comprising a set of shock detectors for determining the existence of a harmful electrical condition in a body of water proximate each of the set of shock detectors. Each of the shock detectors responsive to a harmful electrical condition in a region proximate the shock detector through self-activation of a "danger signal" such as a visual and audible alarm on the shock detector and each of the shock detectors also responsive to a signal of a harmful electrical condition from another shock detector through a wireless activation of a "caution signal" on the shock detector. The shock detector system generating two types of signals a "caution signal" that alerts a person that the body of water does contain remote regions that contain harmful electrical conditions that could injure or kill a person and a "danger signal" that indicates the body of the water proximate the shock detector contains a harmful electrical condition.

The shock detector system including an open water shock detector for measuring the existence of a harmful water voltage in a body of water through the measurement of a voltage gradient on a set of water electrodes with the shock detector including a self testing feature to indicate the shock detector is operating properly before full activation of the shock detector so that when the shock detector in an activated condition the shock detector is useable to either alert a person to a harmful water condition or to allow an operate to use the shock detector to isolate the source of an electrical short in the body of water through a displacement of the shock detector in the body of water.

DESCRIPTION OF THE PREFERRED EMBODIMENT

Figure 1:
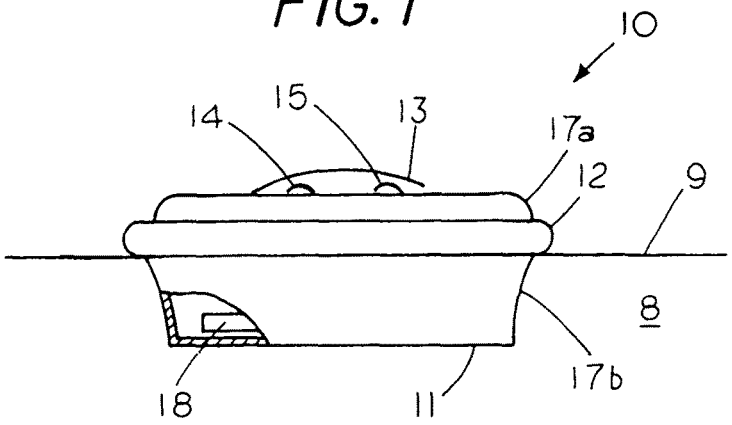
FIG. 1 shows a shock detector floating in a body of water.

FIG. 1 shows a free floating, buoyant, open water shock detector 10 floating upright in a body of water 8 having a water line 9 with the upper housing 17*a* of shock detector 10 including a resilient bumper 12 located around the outer perimeter of the shock detector. The resilient bumper, which is shown located above the water line 9, protects the shock detector in the event the shock detector accidently bumps into an object while floating in the body of water. In this example, the shock detector 10 includes a transparent or see through hemispherical shaped dome 13 extending from a top housing 17*a*, with a green LED light 13 and a red LED light 14 that are both visible from afar through the transparent dome 13. The lower housing 17*b* of shock detector 10, which is below the water line 9, is shown partially cut away to reveal a ballast 18 in the bottom of shock detector 10. A feature of the invention is the use of a ballast in the bottom of the floating shock detector that causes the shock detector 10 to float in the upright condition as shown in FIG. 1 as well as causes the shock detector to right itself in the event the shock detector is accidently flipped upside down as it floats in the body of water. The ballast may either be a dead weight placed in the floating shock detector or it may be strategically placed integral components of the shock detector so that the weight of the strategically placed external and internal shock detector components comprise the necessary ballast for generating a self righting force or torque to the shock detector 10 that is sufficient to return the shock detector to the floating condition as shown in FIG. 1 in the event the shock detector tips over due to an external force such as a wave. A feature of the open water shock detector 10 is that it is ungrounded since it floats in the body of water and measures a voltage gradient within the body of water. A further feature of shock detector 10 is that the shock detector housing and dome are both waterproof and weatherproof, which enables the shock detector to operate while floating in a body of water as well as all types of weather.

Figure 2:
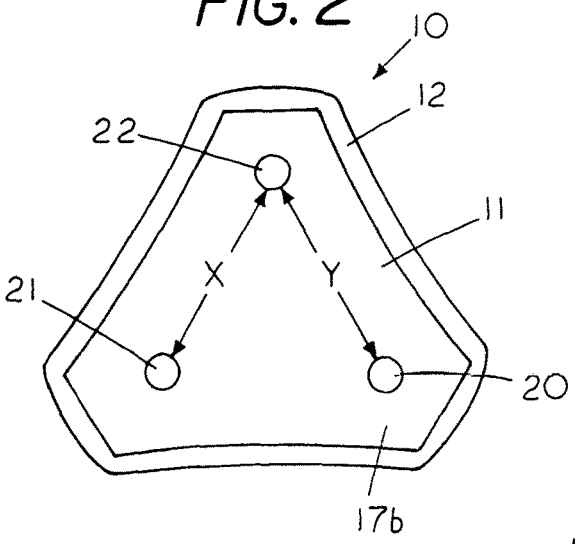
FIG. 2 is a bottom view of the floating shock detector of FIG. 1 revealing a set of three water electrodes.

FIG. 2 is a bottom view of the floating shock detector 10 of FIG. 1, which comprises an ungrounded shock detector since it measures voltages between electrodes located in the body of water without reference to an electrical ground. In this example the shock detector determines the presence of a harmful voltage gradient in the body of water as the shock detector free floats in a body of water. The processor in shock detector 10 measures voltage between a set of spaced apart water electrodes 20, 21 and 22, which are integral to the shock detector, to obtain a voltage difference between the electrodes i.e. a voltage gradient in the body of water and compares to a known voltage gradient that is sufficient to cause injury or death to a person in the body of water. While the shock detector of the invention described herein measures the voltage gradient in the body as it floats in a body of water 8 the shock detector may also be attached to a structure such as a dock and used to measure a voltage difference between a water electrode and an earth ground. In either case the shock detector can determine a hazardous water voltage condition i.e. a voltage gradient within the body of water that could injure or kill a person coming into contact with the body of water.

The voltage gradient, which is referred herein as a water voltage, is based on a measured voltage difference between any of the three electrodes or may be computed based on an average of the measured voltage difference between the three water electrodes. In either event the magnitude of voltage gradient in the body of water is a function of whether the voltage gradient can injure or kill a person that comes into contact with the body of water. In the example shown the shock detector 10 determines if there is a voltage gradient in the body of water that may injure or kill a person that enters the body of water. A feature of the shock detector 10 is that the shock detector can determine the existence of a harmful water voltage gradient in a body of water even though the shock detector is remote from a structure in contact with the body of water. In the example shown the shock detector measures an AC water voltage such as an AC water gradient in the body of water to determine if the water voltage i.e. the AC voltage gradient is such that it would injure or kill a person. In some cases where DC voltages may be present one may measure a DC voltage gradient or in other cases one may measure both AC and DC voltage gradients to determine if the AC or DC water voltage is such that it would injure or kill a person.

FIG. 2 shows the underside 11 of shock detector 10 revealing a set of three circular metal water electrodes located on the bottom side of an ungrounded shock detector 10 that floats in a body of water. The ungrounded shock detector 10 includes, a first water electrode 20, a second water electrode 21 and a third water electrode 22 with the water electrode 21 spaced from the water electrode 22 by the distance x and the water electrode 22 spaced from the water electrode 20 by the distance y with the three electrodes extending through a common plane. In this example the water electrode 20 and water electrode 21 are located along a right angle with the apex located at water electrode 22 and all three water electrodes, which are below the water line, are connected to a processor in shock detector 10 that measures the electric potential between electrodes to obtain the voltage gradient (i.e. volts per foot) in the body of water 8 to determine whether the voltage gradient in the body of water is such that it could cause injury or kill a person who enters the body of water. While a set of three water electrodes allows one to determine the voltage gradient in different directions in the electric field in some applications one may use a set of two water electrodes to determine the voltage gradient in the body of water and in other applications four or more water electrodes may be used to measure the voltage gradients in the body of water.

Figure 3:
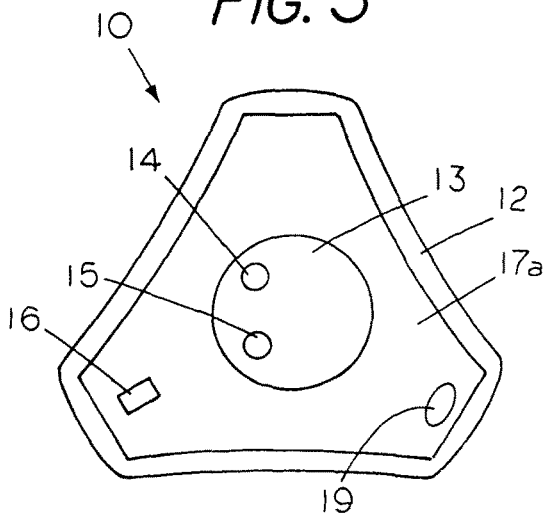
FIG. 3 is a top view of floating shock detector showing the visual and audible alarms.

FIG. 3 is a top view of the floating shock detector 10 showing the central location of the transparent dome 13 with a green LED light 14 and a red LED light 15 visible through the dome 13. The dome provides enhanced visibility since it allows the LED lights to be seen by a person located laterally of the shock detector or a person located above the shock detector. An audible alarm 16 such as a beeper or a buzzer is also located on the top housing 17*a* of the shock detector. An opening 19 in top housing 17*a* forms a loop that allows one to insert a cord therethrough so one can attach the cord to the shock detector. The cord allows the shock detector 10 to be tethered in place in a body of water 8 with an anchor or the like. In addition the shock detector may be tethered to a dock or to a boat to alert persons to the existence of a harmful voltage gradient in a range around the floating shock detector. The feature of a tethered floating shock detector is also useful to a boater coming into an unknown dock since the boater can lower the shock detector into the body of water using the cord attached to the shock detector to test for the presence of a harmful electric field in the body of water before stepping out of the boat. A further advantage of a tethered floating shock detector is that when the boat is in open water one can lower the floating shock detector into the water around the boat to determine if there is a harmful electrical field around the boat, which may be caused by an electrical short in the boat wiring. A feature useful in the event persons want to swim from the boat. Thus, the shock detector described herein may be used in water adjacent a land site or in open water to determine if a voltage gradient is present in the water, which is sufficient to injure or kill a person coming into contact with the body of water.

Figure 4:
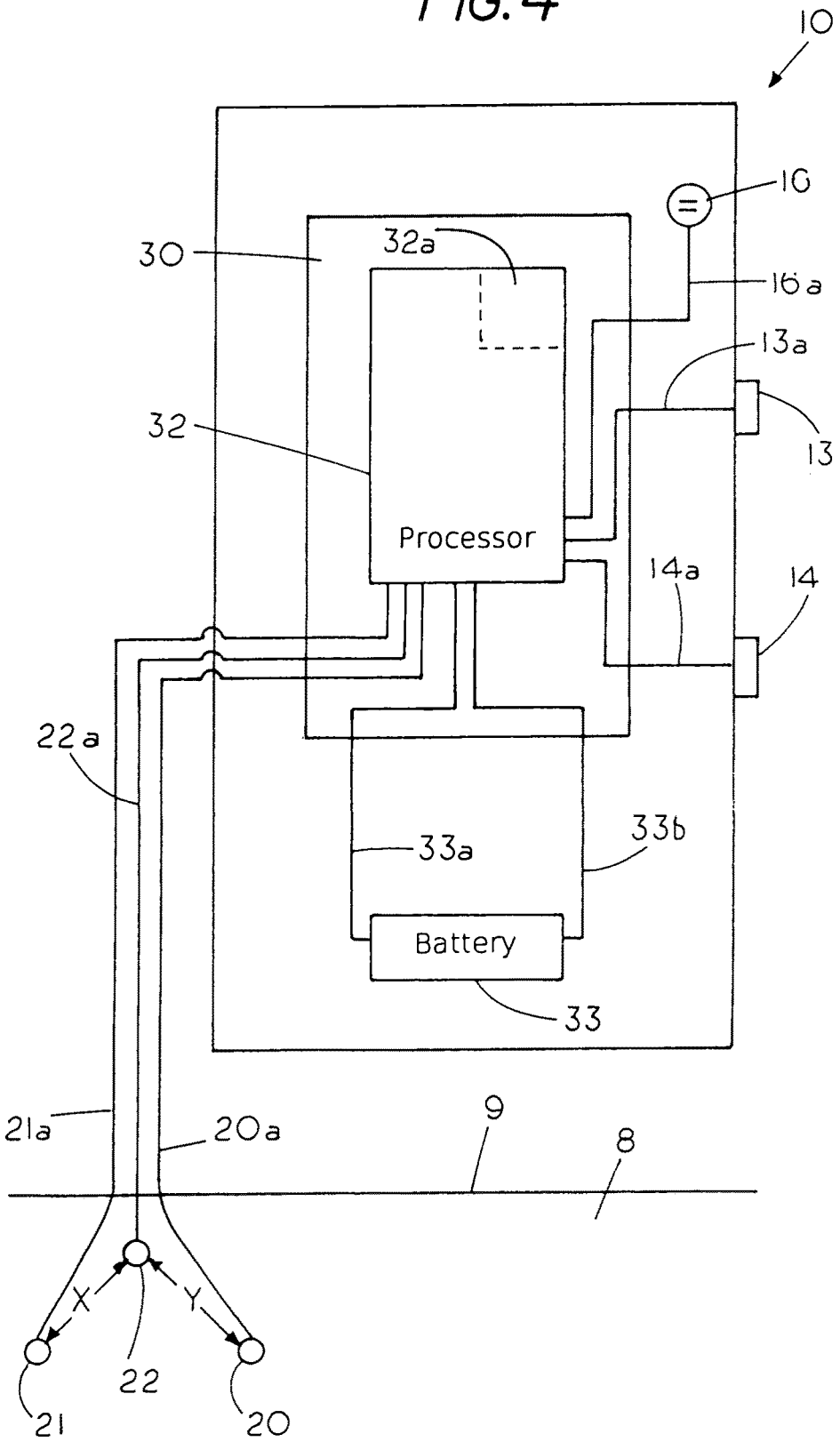
FIG. 4 is a schematic illustrating electronic communications between various components of the shock detector.

FIG. 4 is a schematic illustrating electronic communications between various components of the shock detector 10 and a circuit board 30 containing a processor 32, which in this example includes a transducer 32*a*. In this example the audible alarm 16 connects to processor 32 on circuit board 30 through electrical lead 16*a*. The Red LED light 13 or visual alarm connects to processor 32 on circuit board 30 through electrical lead 13*a* and similarly the green LED light 14 or visual alarm connects to processor 32 on circuit board 30 through electrical lead 14*a*.

Located proximate the circuit board 30 is a battery 33 having a first terminal with a lead 33*a* connected to processor 32 and a second terminal with a lead 33*b* connected to processor 23. In this example the battery 33 provides power to operate the processor 32 as well as the visual alarms 13, 14 and the audible alarm 16.

The set of water electrodes 20, 21 and 22 are shown located in a body of water 8 with an electrical lead 20*a*, connecting water electrode 20 to processor 32, an electrical lead 21*a* connecting water electrode 21 to processor 32 and an electrical lead 22*a* connecting water electrode 22 to processor 32 with all the water electrodes located below the water line 9. The use of three water electrodes enables measurement of water voltage in the body of water between three different locations. In this example, the shock detector 10 measures the water voltage between three electrodes to obtain a voltage gradient within the body of water.

The voltage gradient in a body of water is generally highest proximate a current leak, which is the source of the electrical failure, and decreases the further away from the source of the electrical failure thus creating a potential field within the body of water that decrease in distance from the source of the electrical failure. In this example the processor 32 determines if the strength of the voltage gradient in the body of water is such that it would kill or injure a person coming into contact with the body of water.

Figure 5:
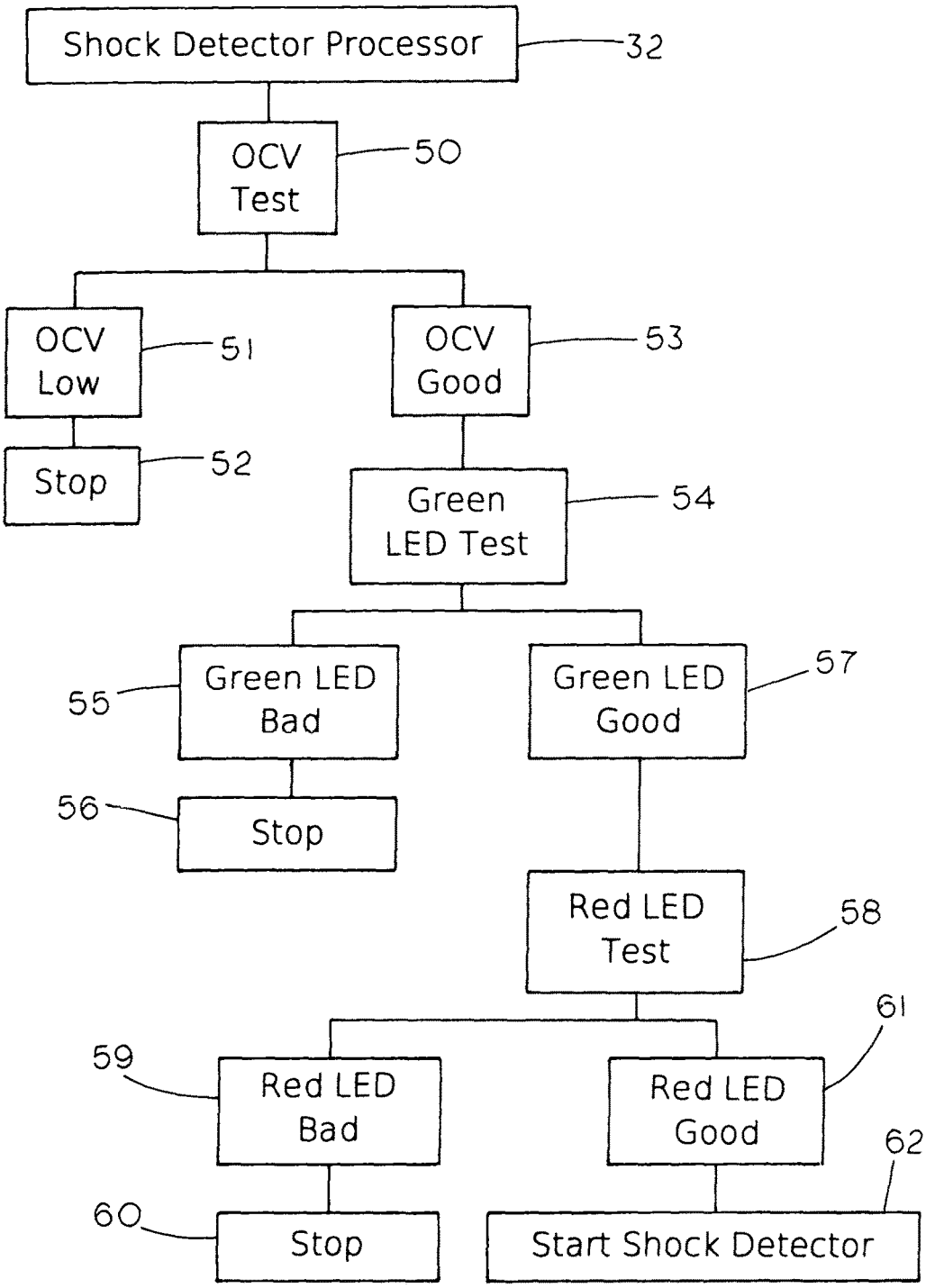
FIG. 5 is a flow chart illustrating the method of self-testing of the shock detector.

A feature of the invention described herein is that before initiating measurements of voltage gradient the shock detector performs a self-test to let a person know the shock detector is operative and ready to be placed in a body of water to determine if the water contains a harmful electrical condition. FIG. 5 shows a flow chart illustrating the method of self-testing of the shock detector 10, which comprises the steps of checking battery voltage under various conditions before the shock detector begins monitoring the voltage gradient in the body of water to determine if a hazardous electrical condition exists i.e. where the voltage gradient is sufficient to deliver an electric shock that can cause injury or death to a person that comes into contact with the body of water.

To initiate the battery self-test the shock detector processor 32 automatically performs a sequence of battery tests under different load conditions. In this example the self-test includes measuring the battery voltage with an open circuit (no load across the terminals of the battery), which is referred to as the open circuit voltage (OCV) test (50) of the battery in the shock detector. If the OCV voltage of the battery is low (51) (i.e. below a preselected voltage threshold) the processor 32 stops the test (52) and prevents the shock detector from start up. If the OCV voltage of the battery is good (53) i.e. above the preset preselected voltage threshold the processor (32) begins the next step by checking the battery voltage under various load conditions. The first test of the battery voltage under load condition is with the green LED light on as illustrated by the green LED test (54). If the battery voltage is below the preselected voltage (i.e. bad) with the green LED on, the processor (32) within the shock detector 10 prevents shock detector start up. On the other hand if the battery voltage with the green LED on is above the preselected voltage (i.e. good) (57) the processor (32) proceeds to the next step in the battery self test cycle where the battery voltage is tested with the red LED on. If the processor determines the battery voltage with the red LED on is bad (59), i.e. below a preselected voltage the processor 32 stops the operation of the shock detector. If the battery voltage of the shock detector is good with the red LED on (61) i.e. above the preselected voltage the processor 32 sends a signal to start the shock detector (62) for measuring the voltage gradient in the body of water. Typically, the cycle for self-test where the battery voltage is measured under different conditions may be repeated after start up to ensure that the battery voltage remains sufficient to measure the voltage gradient and emit an alarm over an extended period of time if the shock detector should detect the presence of harmful voltage gradient or if the battery should be replaced.

A further feature of the invention is that once the shock detector 10 passes the battery self test the shock detector 10 automatically begins monitoring the voltage gradient in a body of water. In operation mode the shock detector 10 provides real time information on the existence of harmful voltage gradient in the body of water, the strength of the voltage gradient in the body of water and the status of the battery in the shock detector through a combination of a red LED light, a green LED light and an audio alarm or beeper. This latter feature of measuring the level or strength of the voltage gradient in the body of water enables shock detector 10 use as a diagnostic tool to determine the location of a voltage leak in the body of water by moving the shock detector in the body of water to find the region in the body of water where the voltage gradient is the highest since the voltage gradient generally decreases with distance from the source of the leak.

Figure 6:
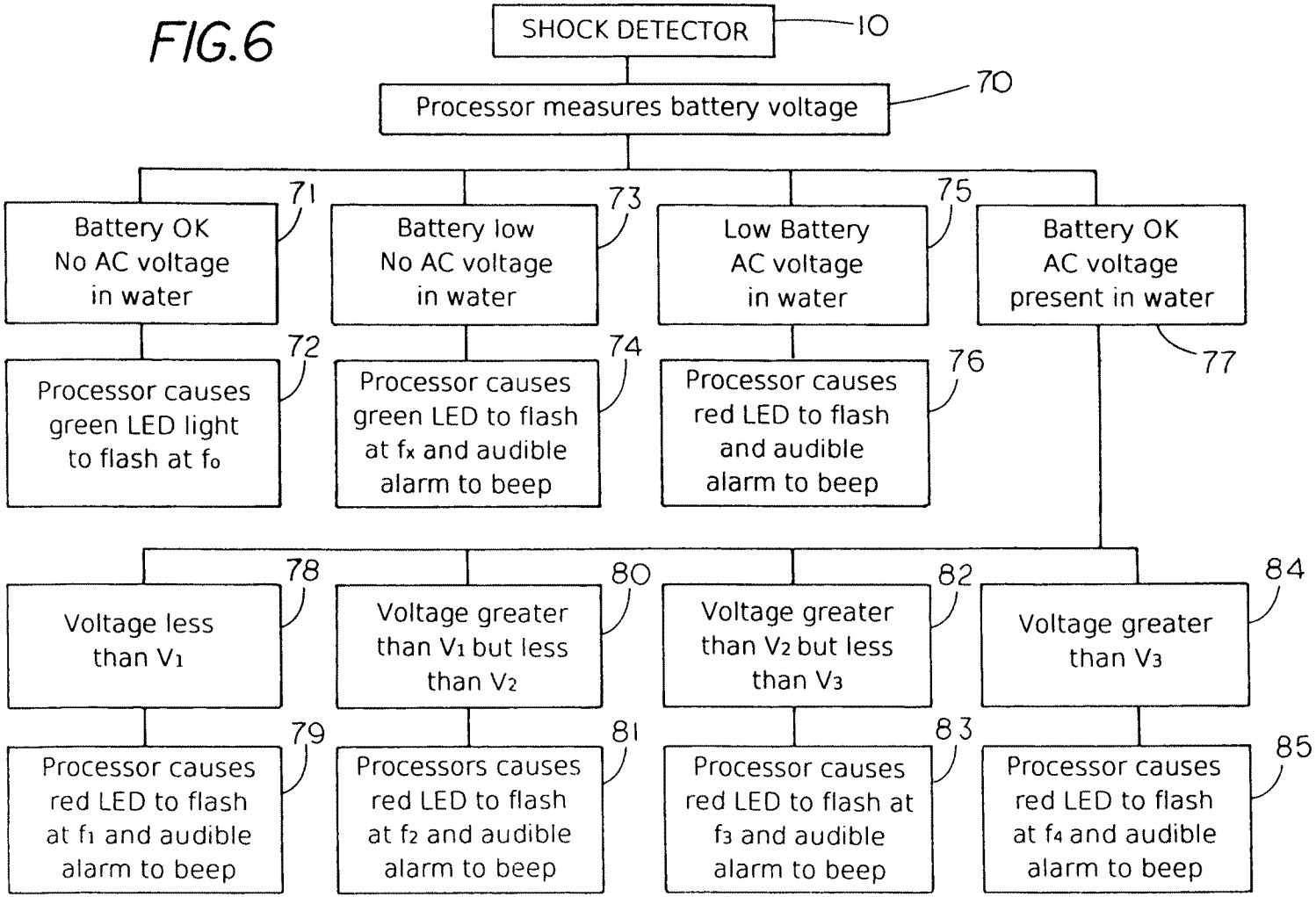
FIG. 6 is a flow chart of the shock detector illustrating the method of determining the presence and the amount of voltage in a body of water.

FIG. 6 is a flow chart of the operation of shock detector 10, which illustrates the method of determining the presence of water voltage as well as the level of the voltage gradient during four field conditions. FIG. 6 shows that during the voltage-measuring phase the processor begins by measuring the battery voltage (70). If the battery voltage is OK (above a preselected level) and there is no AC voltage in the body of water (71) the processor causes a green LED light to flash at a frequency $f_o$ (72).

If the battery voltage in the shock detector 10 is low (below a preselected level) and there is no AC voltage in the body of water (73) the processor causes the green LED light to flash at a frequency $f_x$ and an audible alarm to beep (74) where the frequency $f_x$ is different from the frequency $f_o$. In this mode the operator is alerted to replace the battery in the shock detector. Thus the shock detector through the type of signals alerts the observer that that there is no water voltage but in one case it alerts the observer that the battery in the shock detector should be replaced even though no AC voltage has been detected.

If the battery voltage in the shock detector is low (i.e. below a preselected level) (75) and there is AC voltage in the body of water the processor causes the red LED light to flash and an audible alarm to beep (76) thus alerting the person to the hazardous condition as well as the fact the battery is low and needs to be replaced.

If the battery voltage in the shock detector is OK (i.e. above a preselected voltage) and there exists an AC voltage in the body of water (77) the processor in the shock detector provides more information such as the level of AC voltage gradient in the body of water. In this example the processor provides an audible alarm as well as visual alarm signals, which are based on difference in frequency of the flashing of the Red LED light.

The processor also has the ability to determine different levels of voltage gradients and alert an operator not only to the existence of a water voltage and a voltage gradient but the level or strength of the voltage gradient. As shown in the FIG. 6 flow chart, if the processor determines that the water voltage gradient is less than a preselected water voltage gradient $V_1$ (78) the processor causes the Red LED light to flash at a frequency $f_1$ and the audible alarm to beep (79).

If the processor determines the water voltage gradient is greater than $V_1$ but less than $V_2$ where $V_1$ and $V_2$ are preselected water voltage gradients (80) the processor causes the red LED to flash at a frequency $f_2$ and the audible alarm to beep (81) where the frequency $f_2$ is different from $f_1$.

If the processor determines the water voltage gradient is greater than $V_2$ but less than $V_3$ where $V_3$ is a preselected water voltage gradient (82) the processor cause the red LED light to flash at a frequency $f_3$ and the audible alarm to beep (83) where the frequency $f_3$ is different from $f_2$ and $f_1$.

In the event the processor determines the voltage gradient in the body of water is greater than $V_3$ (84) the processor then cause the red LED light to flash at a frequency $f_4$ and the audible alarm to beep (85) where the frequency $f_4$ is different from $f_3$, $f_2$ and $f_1$.

Thus, a feature of the invention is that the shock detector 10 provides unique open water informational signals responsive to a range of voltage conditions to alert an operator to the water voltage danger in the body of water but also the level of the voltage gradient in the body of water. The feature of being able to send different signals for different voltages in the body allows the shock detector to become a diagnostic tool for locating the cause of the electrical short in open water by using the shock detector to locate where the voltage gradient in the body of water is the highest. That is by displacement or movement of the shock detector in the body of water one can determine where the voltage gradient is highest by the change in frequency of the flashing red LED light. By searching in the area where the shock detector measures the highest voltage gradient one limits the search area thus enabling one to more quickly find the problem causing voltage leak into the body of water.

Figure 7:
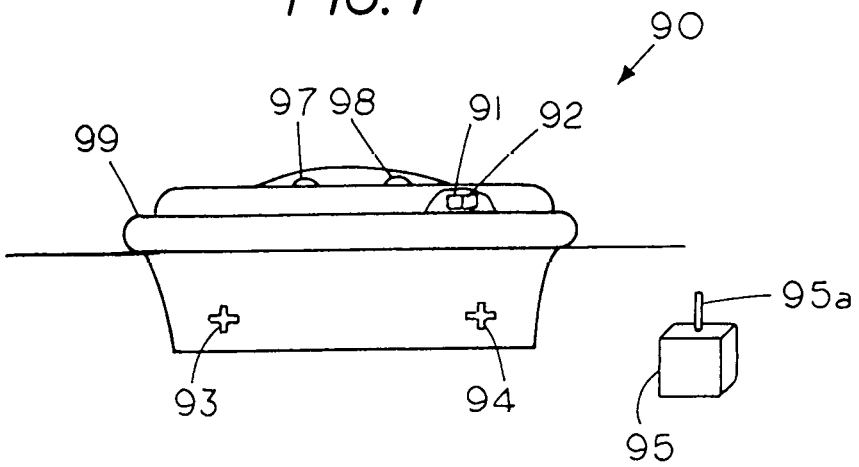
FIG. 7 shows a shock detector with a propulsion system.

FIG. 7 shows an example of a water propelled shock detector 90, which is identical to shock detector 10 except shock detector 90 includes means to move the shock detector from location to location in an open body of water. In this example shock detector 90 includes a first propeller 91 and a second propeller 94, an internal power source such as a battery and a radio-control 92 as typically used in powered model boats. A remote control box 95 and a joy stick 95*a* allows the operator to move the shock detector 90 to different locations in the body of water through control of the rotation of propellers 93 and 94 while the red LED light 97, the green LED light 98 and the beeper 99 provide information as to the presence of a voltage gradient but also the strength of the voltage gradient. Thus, the shock detector can be moved about in the body of open water without a person coming into contact with the body of water. Although, steering of the shock detector can be controlled by use of two propellers other methods of steering including a single pivoting propeller may be used without departing from the spirit and scope of the invention. Thus, with the use of a remote controller 95 an operator can remain on shore and away from contact with the water as the operator moves the shock detector 90 to various locations in the body of water, where the shock detector 90 can determine the existence as well as the strength of the voltage gradient. This feature of a remote controlled shock detector is not only useful in locating regions of high water voltage but is also useful in extending the range of the shock detector since the shock detector can be moved to a different location in the body of water to determine if there exists a harmful voltage gradient at a different location. That is, the shock detector typically has a useful range in determining a voltage gradient since the water voltage gradient decreases the further one is from the source of the electrical short. The decrease in water voltage gradient based on the distance from the electrical short is dependent on various factors including the salinity of the water. With the water propelled shock detector 90 one can move the shock detector about in the body of water to determine if harmful voltage gradients exist in other portion of the body of water. This feature is also useful in cases where the harmful water gradient is outside the normal range of the shock detector since one shock detector can be used to monitor harmful voltage gradients over an extended range by moving the shock detector from location to location. In other cases one may program the remote to direct the shock detector to automatically measure the voltage gradients at different locations in the body of water.

A further feature of shock detector 90 is a transmitter 91 that can send information on the harmful voltage gradient to a remote location. For example, the transmitter output may be in communication with an emergency squad, a power company or an entity that can respond if the shock detector determines a water voltage gradient has exceed a dangerous threshold that would injure or electrocute a person.

Figure 8:
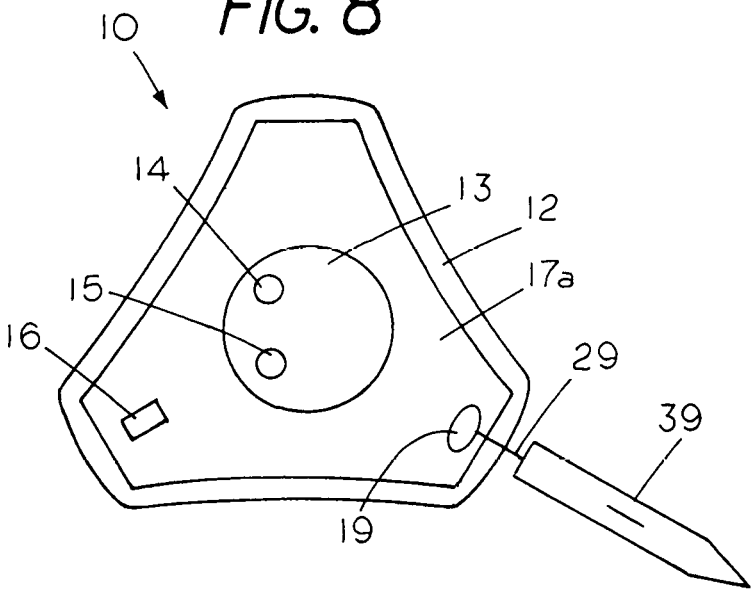
FIG. 8 shows the shock detector towed and controlled by a model boat.

FIG. 8 shows the shock detector 10 may be moved about in open water through the coupling of the shock detector 10 to a conventional remote controlled model powerboat 39, which is attached to shock detector 10 by an electrically insulating cord 29. In this example, the model boat 39 and its remote control can be used to tow the shock detector 10 to various open water positions on the body of water.

One of the features of the invention is the use of electrically insulated cord 29, which is secured to the shock detector 10 to prevent a person from coming into contact with a harmful voltage gradient as a person places the shock detector into the body of water while holding on to the electrical insulated cord 29. Since the shock detector is portable one needs to avoid contact with the body of a water 8 during placement of the shock detector 10 in the body of water since the electrically insulated cord can prevent injury or harm to the person during the placement of the shock detector into the body of water in the event the water contains a harmful voltage gradient.

Figure 9:
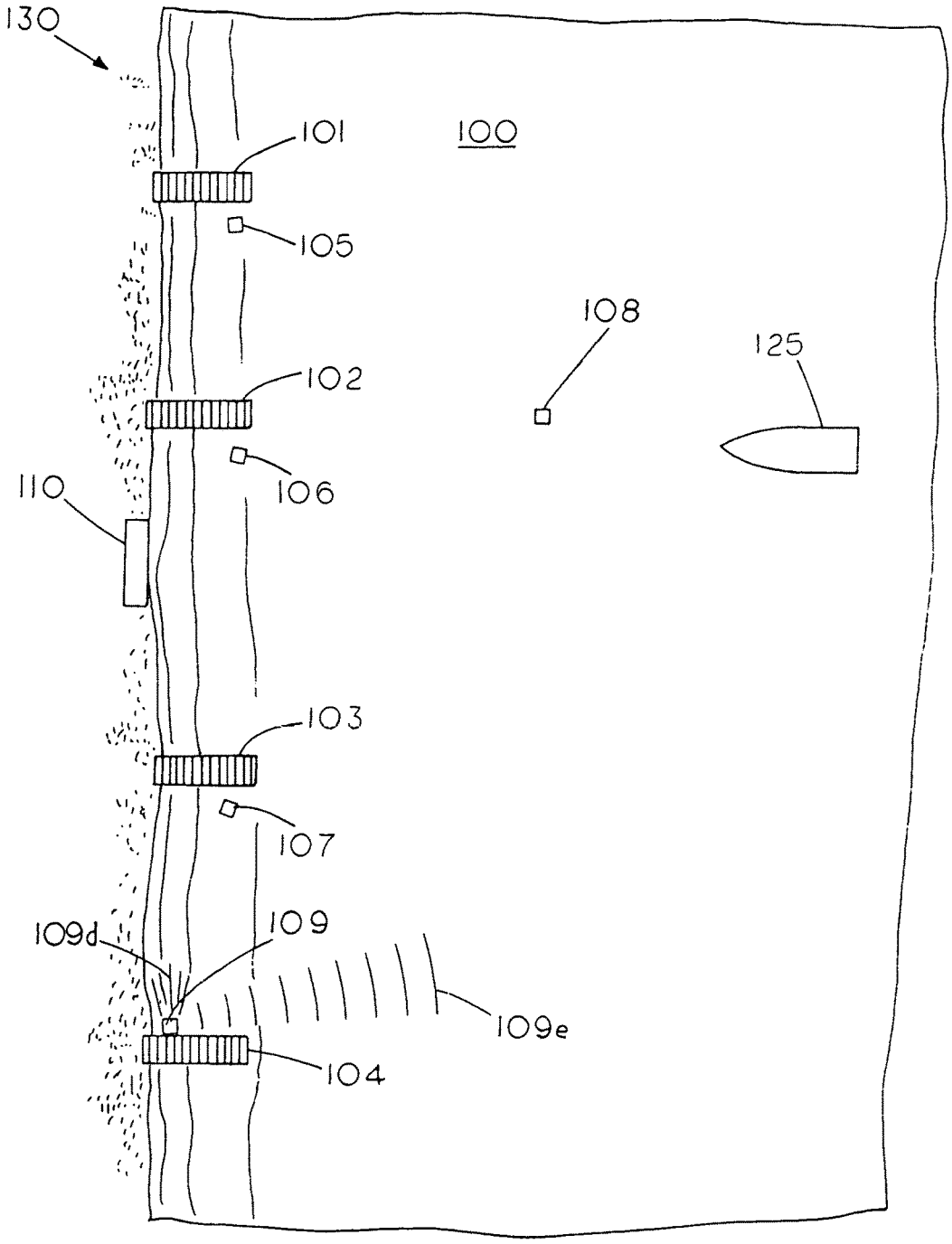
FIG. 9 shows a body of water with a set of shock detectors located in different locations on the body of water.

A reference to FIG. 9 shows a body of water 100 with a shock detector system 130 comprising a set of five shock detectors 105, 106, 107, 108 and 109 with each shock detector capable of independently determining the existence of a harmful electrical condition that could kill or injure a person in a region proximate each of the shock detectors. In this example the body of water 100 includes a dock 101 with a floating shock detector 105 proximate the dock 101, a floating shock detector 106 proximate the dock 102, a floating shock detector 107 proximate the dock 103 and a dock mounted shock detector 109 mounted on dock 104. A further floating shock detector 108 is located in open water and away from the docks. A boat 125 shown in the body of water is approaching the docks. In addition to the floating shock detectors 105, 106, 107 and 108 and the dock-mounted shock detector 108 there is included an on shore monitoring station 110 for receiving signals from each of the shock detectors. In this example, each of the signals received by the shore station identifies any shock detector that is detecting a harmful electrical condition proximate the shock detector and therefore the portion of the body of water that contains the harmful electrical condition and should be avoided. A feature of monitoring station 110 is that one can observe the status of each of the set of shock detectors to determine a location of the portion of the body of water that contains a harmful electrical condition that could injure or kill a person.

Figure 10:
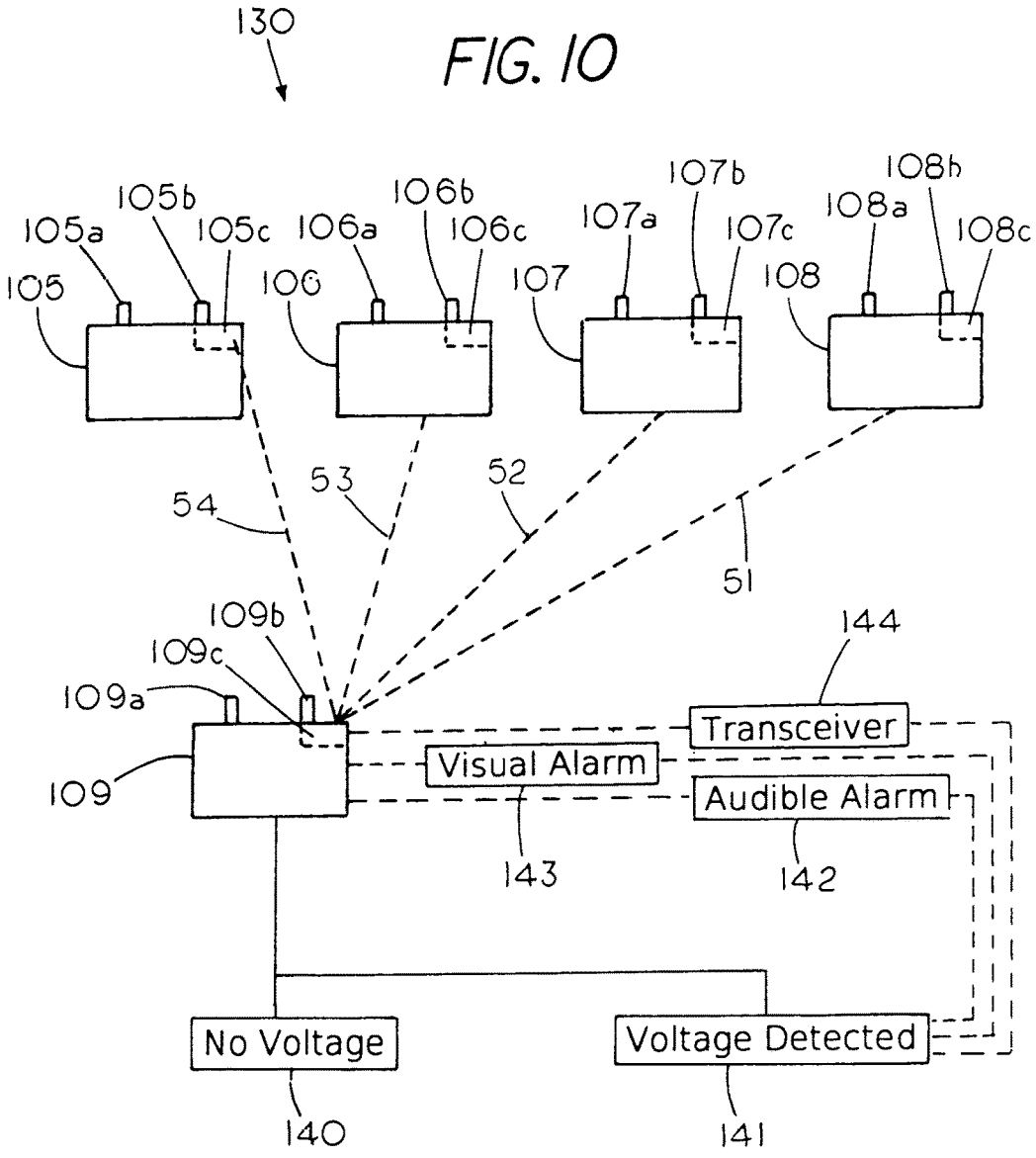
FIG. 10 shows a partial schematic view of a set of shock detectors.

FIG. 10 shows a partial schematic view of the shock detector system 130. Each of the shock detectors includes a visual alarm, an audible alarm and a transceiver for two-way wireless communication with each other and with a remote control station. That is, shock detector 105 includes an audible alarm 105*a*, a visual alarm 105*b* and a transceiver 105*c*. Similarly, shock detector 106 includes an audible alarm 106*a*, a visual alarm 106*b* and a transceiver 106*c*; shock detector 107 includes an audible alarm 107*a*, a visual alarm 107*b* and a transceiver 107*c*, shock detector 108 includes an audible alarm 108*a*, a visual alarm 108*b* and a transceiver 108*c* and shock detector 109 includes an audible alarm 109*a*, a visual alarm 109*b* and a transceiver 109*c*.

FIG. 10 shows the set of shock detectors, 105, 106, 107, 108, and 109 with dashed lines indicating two way wireless communication between the shock detectors when one of the shock detectors in this case shock detector 109 detects a harmful electrical condition that could injure or kill a person in the body of water proximate the shock detector. FIG. 10 shows that if there is no voltage present in the body of water no signals are sent from the shock detector 109 as indicated by No Voltage (140). However, if a voltage is detected (141) the processor in the shock detector generates three signals, a first audible alarm signal (142) for shock detector 109, a second visual alarm signal (142) for shock detector 109 and a third transceiver signal (144) that is transmitted to each of the other shock detectors. In this example transceiver 109*c* transmits an alarm signal (51) to shock detector 108, an alarm signal (52) to shock detector 107, an alarm signal (53) to shock detector 106 and an alarm signal (54) to shock detector 105.

Figure 11:
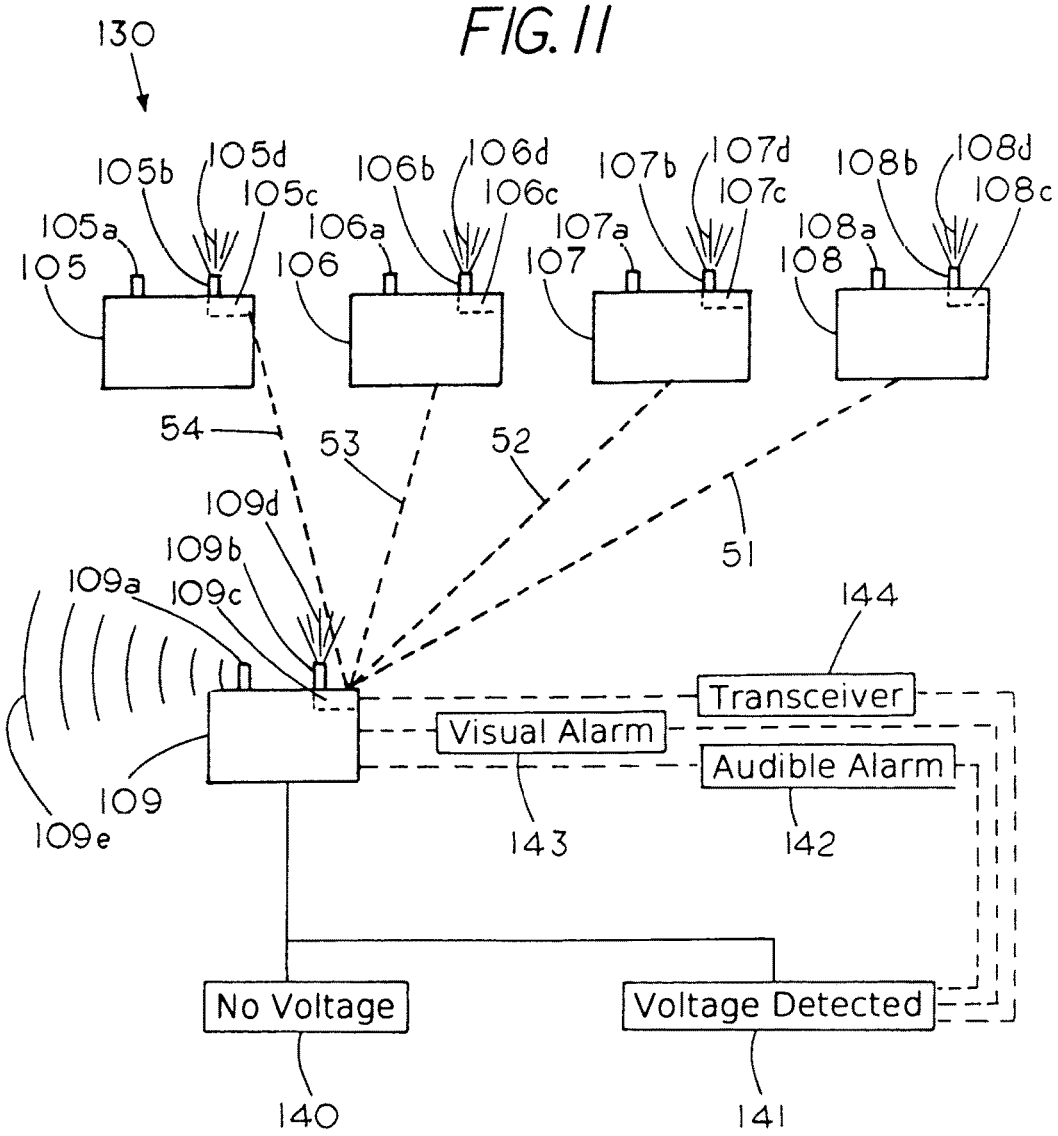
FIG. 11 shows the partial schematic view of FIG. 10 showing the alarm response of shock detectors when one of the shock detectors determines the existence of a harmful electrical condition proximate only one of the shock detectors.

FIG. 11 illustrates a shock detector system 130 where shock detector 109 detects a hazardous electrical condition proximate shock detector 109 but shock detectors 105, 106, 107 and 108 do not detect a hazardous electrical condition proximate shock detectors 105, 106, 107 and 108. When a hazardous electrical condition is detected proximate shock detector 109 the shock detector 109 generates a danger signal comprising both a visual and audible alarm. In this case the audible alarm signal (142) activates the audible alarm 109*a* as indicated by the sound waves 109*e* emanating from audible alarm 109*a*. In addition the visual alarm signal (143) generates a visual signal 109*d* from visual display 109*b*, which may be a flashing light or the like including a flashing LED. As can be seen the presence of a harmful voltage condition in the body of water proximate shock detector 109 activates both the visual alarm 109*b* and the audible alarm 109*a* thereby generating a "danger signal" alerting a person to the existence of a hazardous electrical condition proximate shock detector 109. In this example there is no hazardous electrical condition proximate the shock detectors 105, 106, 107 and 108 even though each are in the same body of water, a condition that occurs as a natural result of the path followed by the electrical energy in the body of water. The extent of the harmful electrical field in a body of water is dependent on various conditions within the body of water and may not remain static. Consequently, one region of the body of water may have a harmful electrical condition while another may not. Although one portion of the body of water may contain a region with a harmful electrical condition that could injure or kill a person there is usually no definite boundary between the regions that contain the harmful electrical condition and those that do not contain the harmful electrical condition.

Shock detector 109, which senses the presence of a harmful electrical condition provides both a visual signal 109*d* and an audible signal 109*e* i.e. a "danger signal" to alert a person to the presence of a hazardous electrical condition in the body of water. At the same time the transceiver 109*d* in shock detector sends an alarm signal 51 to shock detector 108 that generates a visual signal 108*d* from visual indicator 108*b* i.e. a "caution signal". Similarly, the transceiver 109*c* in shock detector sends an alarm signal 52 to shock detector 107 that generates a visual signal 107*d* from visual indicator 107*b* i.e. a "caution signal", an alarm signal 53 to shock detector 106 that generates a visual signal 106*d* from visual indicator 106*b* i.e. a "caution signal"; an alarm signal 54 to shock detector 105 that generates a visual signal 105*d* from visual indicator 105*b* i.e. a "caution signal". Thus, even though the shock detectors 105, 106, 107 and 108, which are in the same body of water as shock detector 109, do not detect a hazardous electrical condition they generate a "caution signal" to alert those in the area that there is a region of the body of water that does contain a hazardous electrical water condition that could injure of kill a person. In the example shown the shock detector 109, which detects the hazardous electrical condition, generates both a visual signal and an audible alarm (danger signal) while the other shock detectors generate a single signal (caution signal) to alert a person that other regions of the body of water may contain a hazardous electrical condition. Thus a boat 125 entering the area becomes aware of hazardous electrical conditions in other regions of the body of water 100.

In another example the remote shock detectors, which do not detect the harmful electrical condition, may show a "caution signal" that may be both an audible alarm and a visual alarm, however, the audible alarm or the visual alarm for the "caution signal" would be a different signal than the "danger signal" so that one could readily determine if the harmful electrical condition is actually present proximate the shock detector that is being observed. For example, either or both the frequency of light flashes or the frequency of the audible alarm could be different for the "caution signal" and "danger signal.

Although more or less shock detectors may be used in this example the shock detector system 130 includes five shock detectors 105, 106, 107, 108 and 109 that are all operable for determining the existence of a harmful electrical condition in a body of water proximate the shock detector. If the harmful electrical condition is present by one or more but not all of the shock detectors in the body of water a signal is sent to the other shock detectors, which do not sense a harmful electrical condition, to activate an alarm that indicates the presence of hazardous condition somewhere in the body of water other than by the shock detector. Thus, the system 130 generates two types of signals, an immediate danger signal that may be both a visual and an audible alarm that warns a person of the local existence of the hazardous condition proximate the shock detector and a caution signal, which is sent to shock detectors outside the water with the harmful electrical condition to warn a person that a hazardous electrical field may be nearby although not at the shock detector that generates the caution signal. While the example shown describes the detection of a hazardous electrical conditions proximate shock detector 109 each of the shock detectors 105, 106, 107 and 108 are responsive to a harmful electrical condition in a region proximate the shock detector through the self activation of a visual and an audible alarm on the shock detector located in the region of the body of water containing the harmful electrical condition as well as the remote activating of a different alarm signal on a shock detector in a region of the body of water, which does not contain a harmful electrical condition through the use of a transceiver in each of the shock detectors. Thus, in some cases there may be two shock detectors indicating the present of a hazardous electrical condition present two of the shock detectors while the other shock detectors in the system indicate that there is a hazardous electrical condition somewhere in the body of water. In other cases all five of the shock detectors may be indicating a harmful electrical condition present each of the shock detectors. Thus the shock detector system provides a range of messages to those in the area. In still other cases the transceivers in the shock detectors may transmit a signal to an on land monitoring station 110 where a person can be alerted to a harmful water condition even though the person may not be able to hear or see the alarm signals from the shock detectors in contact with the body of water.

A feature of the invention is that each of the shock detectors include two-way wireless communication with each other so that if a one of the shock detectors of the set of shock detectors activates a danger signal such as an audible and visual alarm in response to a harmful voltage proximate it automatically communicates with other shock detectors in the set of shock detectors to activate a different alarm i.e. a "caution signal" on each of the other shock detectors to thereby alert a person proximate the other shock detectors that there is a harmful electrical condition in the body of water although the harmful electrical condition may not be proximate the other shock detectors in the set of shock detectors.

Another feature of the invention is that the shock detectors remain live. That is, the shock detectors continue to monitor harmful electrical conditions in the body of water even though they a shock detector may be emitting a caution signal, which is a warning of a harmful electrical condition proximate another shock detector. Should a shock detector, which is emitting a caution signal, detect a harmful electrical condition the shock detector caution signal changes to a danger signal. In the example where only a visual alarm is used for a caution signal and both a visual alarm and an audible alarm are used for the alarm signal the visual alarm signal changes to both a visual alarm signal and an audible alarm signal when the region proximate the shock detector contains a harmful electrical condition. Thus, the shock detectors in the system include shock detectors for delivering two alert states i.e. a "caution signal", which indicates there is a harmful electrical condition somewhere in the body of water and a "danger signal" condition that indicates there is a harmful electrical condition proximate the shock detector.

We claim:

1. A shock detector comprising:

a housing having a first water electrode for immersing in a body of water and a second electrode;

a processor for measuring a harmful electrical condition between said first water electrode and said second electrode in a region proximate the shock detector;

an audible alarm for alerting a person to the existence of a harmful electrical condition in the body of water proximate the shock detector where the harmful electrical condition is such that it could injure or electrocute a person;

a visual alarm for alerting a person to the existence of the harmful electrical condition in the body of water proximate the shock detector where the harmful electrical condition is such that it could injure or electrocute a person; and a transceiver on the shock detector for communication with a further shock detector located in a region in the body of water that does not contain the harmful electrical condition with said transceiver activating a visual alarm on the further shock detector but not the audible alarm on the further shock detector in response to the harmful electrical condition proximate the shock detector to thereby alert a person to the existence of a harmful electrical condition in the region proximate the shock detector but not in the region proximate the further shock detector.

2. The shock detector of claim 1 including an on shore receiver for monitoring an alarm status of the shock detector and the further shock detector where the on shore receiver is responsive to a wireless signal from the shock detector.

3. The shock detector of claim 1 wherein the harmful electrical condition is a harmful voltage gradient or a harmful voltage.

4. A shock detector system comprising a set of shock detectors capable of independently determining the existence of a harmful electrical condition in a body of water where the harmful electrical condition could kill or injure a person in the body of water with at least two of said set of shock detectors each including a transceiver for communication with each other so that if a one of the at least two set of shock detectors activates a first danger signal in response to a harmful voltage proximate thereto a transceiver communication therefrom activates a caution signal on another of the set of shock detectors that is not in water that has a harmful electrical condition to thereby alert a person proximate the another of the set of shock detectors that there is a harmful electrical condition in the body of water although the harmful electrical condition is not proximate the another of the set of shock detectors with the caution signal.

5. The shock detector system of claim 4 wherein each of the shock detectors in the set of shock detectors can determine the presence of a harmful voltage condition that could kill or injure a person and at least one of the set of shock detectors is battery powered.

6. The shock detector system of claim 4 wherein the shock detectors in the set of shock detectors can determine the presence of a harmful current condition or a harmful voltage condition that could kill or injure a person.

7. The shock detector system of claim 4 including a monitoring station wherein at least one of the set of shock detectors is shore mounted and AC powered.

8. The shock detector system of claim 4 wherein at least one of the set of shock detectors is a battery powered floating shock detector.

9. The shock detector system of claim 4 including a monitoring station wherein one can observe the status of each of the set of shock detectors to determine a location of the portion of the body of water that contains a harmful electrical condition that could injure or kill a person.

10. A shock detector comprising:

a processor for determining the existence of a harmful electrical condition in a body of water that could injure or kill a person in contact with the body of water proximate the shock detector; and an audible alarm and a visual alarm on said shock detector with said audible and visual alarm jointly responsive to a harmful electrical condition proximate the shock detector with either the audible alarm or the visual alarm on the shock detector separately responsive to a signal from a remote shock detector when there is a harmful electrical condition proximate the remote shock detector to thereby alert a person that there is a harmful electrical condition that could kill or injure a person in another portion of the body of water.

11. The shock detector of claim 10 wherein the harmful electrical condition is a harmful voltage condition or a harmful current condition.

12. The shock detector of claim 10 wherein the remote shock detector is either a floating shock detector or a shore mounted shock detector.

13. A method of monitoring a body of water to determine a presence of a harmful electrical condition that could injure or kill a person comprising the steps of:

placing a first shock detector in a first portion of a body of water where the first shock detector includes a first alarm for alerting a person to the existence of the harmful electrical condition proximate the first shock detector through the activation of the first alarm on the first shock detector; and placing a second shock detector in communication with a further portion of the body of water where the second shock detector is in communication with the first shock detector and includes a further alarm for alerting a person to the existence of a harmful electrical condition in the first portion of the body of water even in the absence of a harmful electrical condition in the body of water proximate the second shock detector.

14. The method of claim 13 wherein the step of placing the first shock detector in the first portion of the body of water comprises placing an electrode into the first portion of the body of water.

15. The method of claim 13 including the step of transmitting a wireless signal from the first shock detector to the second shock detector in response to the existence of the harmful electrical condition proximate the first shock detector wherein the signal activates an alarm on the second shock detector that indicates the presence of the harmful electrical condition proximate the first shock detector but not proximate the second shock detector.

16. The method of claim 15 including the step of placing at least one of the shock detectors in the body of water and one of the shock detectors on shore with at least one electrode on the one of shock detectors in contact with the body of water.

17. The method of claim 13 including placing a remote monitoring station in communication with the first shock detector and the second shock detector to provide a remote signal of the status of the body of water proximate the first shock detector and the second shock detector.

18. The method of claim 13 including the step of changing a caution signal on the second shock detector to a danger signal when the second shock detector detects a harmful electrical condition proximate the second shock detector.

19. The method of claim 13 including step of placing shock detectors in the body of water comprises placing at least one ac powered shock detector and one battery powered shock detector in the body of water.

20. The method of claim 15 including the step of changing the alarm on the second shock detector from a caution signal to a danger signal.

* * * * *